US007150608B2

(12) United States Patent
Cho et al.

(10) Patent No.: US 7,150,608 B2
(45) **Date of Patent: *Dec. 19, 2006**

(54) VARIABLE CAPACITY ROTARY COMPRESSOR

(75) Inventors: Sung Hea Cho, Suwon-Si (KR); Seung Kap Lee, Suwon-Si (KR); Chun Mo Sung, Hwasung-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 178 days.

This patent is subject to a terminal disclaimer.

(21) Appl. No.: 10/923,736

(22) Filed: Aug. 24, 2004

(65) Prior Publication Data

US 2005/0129551 A1 Jun. 16, 2005

(30) Foreign Application Priority Data

Dec. 16, 2003 (KR) ..... 10-2003-0092199

(51) Int. Cl.
*F01C 21/16* (2006.01)

(52) U.S. Cl. ..... 418/29; 418/60; 417/218; 417/221; 417/410.3

(58) Field of Classification Search ..... 418/29, 418/57, 60, 69; 417/218, 221, 223, 287, 417/298, 410.3
See application file for complete search history.

(56) References Cited

U.S. PATENT DOCUMENTS 3,904,321 A * 9/1975 Reudi et al. ..... 417/283
4,397,618 A * 8/1983 Stenzel ..... 418/23
5,871,342 A * 2/1999 Harte et al. ..... 418/6
6,009,583 A * 1/2000 Swanstrom, Jr. ..... 7/133
6,962,486 B1 * 11/2005 Lee et al. ..... 417/218
2004/0071560 A1 * 4/2004 Cho et al. ..... 417/223
2005/0079071 A1 * 4/2005 Cho et al. ..... 417/410.3
2005/0207925 A1 * 9/2005 Cho et al. ..... 418/29
2006/0034720 A1 * 2/2006 Lee ..... 418/29

OTHER PUBLICATIONS

U.S. Appl. No. 10/352,000, filed Jan. 28, 2003, Sung-Hea Cho et al., Samsung Electronics Co., Ltd.

* cited by examiner

*Primary Examiner*—Hoang Nguyen
(74) *Attorney, Agent, or Firm*—Staas & Halsey LLP

(57) ABSTRACT

A variable capacity rotary compressor including upper and lower compression chambers in which compressing operations are carried out. A slot is provided at a predetermined position between upper and lower eccentric bushes. A locking pin makes either of the upper and lower eccentric bushes be disposed at a maximum eccentric position. Since the locking pin has a diameter which is larger than a locking hole in a shaft by about 0.02 mm to 0.06 mm, the locking pin is fitted into the locking hole in a press-fit method. Further, the locking hole has a threaded part and a non-threaded part, and the locking pin has a threaded part to correspond to the threaded part of the locking hole and a non-threaded part to correspond to the non-threaded part of the locking hole.

12 Claims, 7 Drawing Sheets

VARIABLE CAPACITY ROTARY COMPRESSOR

CROSS-REFERENCE TO RELATED APPLICATION

This application claims the benefit of Korean Patent Application No. 2003-92199, filed Dec. 16, 2003 in the Korean Intellectual Property Office, the disclosure of which is incorporated herein by reference.

BACKGROUND OF THE INVENTION

1. Field of the Invention

The present invention relates, in general, to rotary compressors and, more particularly, to a variable capacity rotary compressor, which is designed such that a compression operation is executed in either of two compression chambers having different capacities, by an eccentric unit mounted to a rotating shaft.

2. Description of the Related Art

Generally, a compressor is installed in a refrigeration system, such as an air conditioner and a refrigerator, which cools air in a given space using a refrigeration cycle. In the refrigeration system, the compressor compresses a refrigerant which circulates through a refrigeration circuit. A cooling capacity of the refrigeration system is determined according to a compression capacity of the compressor. Thus, when the compressor is designed to vary a compression capacity thereof as desired, the refrigeration system may be operated under an optimum condition considering several factors, such as a difference between a practical temperature and a predetermined temperature, thus allowing air in a given space to be efficiently cooled, and saving energy.

A variety of compressors have been used in the refrigeration system. The compressors have been typically classified into two types, which are rotary compressors and reciprocating compressors. The present invention relates to the rotary compressor, which will be described in the following.

The conventional rotary compressor includes a hermetic casing, with a stator and a rotor bding installed in the hermetic casing. A rotating shaft penetrates through the rotor. An eccentric cam is integrally provided on an outer surface of the rotating shaft. A roller is provided in a compression chamber to be rotated over the eccentric cam.

The rotary compressor constructed as described above is operated as follows. As the rotating shaft rotates, the eccentric cam and the roller execute eccentric rotation in the compression chamber. At the time, a gas refrigerant is drawn into the compression chamber and then compressed, prior to discharging the compressed refrigerant to an outside of the hermetic casing.

However, the conventional rotary compressor has a problem in that the rotary compressor is fixed in a compression capacity thereof, so that it is impossible to vary the compression capacity according to a difference between an environmental temperature and a preset reference temperature.

In a detailed description, when the environmental temperature is considerably higher than the preset reference temperature, the compressor must be operated in a large capacity compression mode to rapidly lower the environmental temperature. Meanwhile, when the difference between the environmental temperature and the preset reference temperature is not large, the compressor must be operated in a small capacity compression mode so as to save energy. However, it is impossible to change the capacity of the rotary compressor according to the difference between the environmental temperature and the preset reference temperature, so that the conventional rotary compressor does not efficiently cope with a variance in temperature, thus leading to a waste of energy.

SUMMARY OF THE INVENTION

Accordingly, it is an aspect of the present invention to provide a variable capacity rotary compressor, which is constructed so that a compression operation is executed in either of two compression chambers having different capacities by an eccentric unit mounted to a rotating shaft, thus varying a compression capacity as desired.

It is a further aspect of the present invention to prevent a locking pin from being loosened from a locking hole even when there occurs a vibration by an operation of the compressor.

It is an another aspect of the present invention to provide a variable capacity rotary compressor in which some of the parts do not become loosened during an operation of the rotary compressor.

Additional and/or other aspects and r advantages of the invention will be set forth in part in the description which follows and, in part, will be obvious from the description, or may be learned by practice of the invention.

The above and/or other aspects are achieved by a variable capacity rotary compressor, including upper and lower compression chambers, a rotating shaft, upper and lower eccentric cams, upper and lower eccentric bushes, a slot, and a locking pin. The upper and lower compression chambers have different capacities. The rotating shaft passes through the upper and lower compression chambers, with a locking hole provided on a predetermined portion of the rotating shaft. The upper and lower eccentric cams are provided on the rotating shaft to be eccentric from the rotating shaft, and are placed in the upper and lower compression chambers, respectively. The upper and lower eccentric bushes are fitted over the upper and lower eccentric cams, respectively. The slot is provided at a predetermined position between the upper and lower eccentric bushes. The locking pin is fitted into the locking hole of the rotating shaft, and is stopped by either of opposite ends of the slot according to a rotating direction of the rotating shaft. Further, the locking pin has a larger diameter than the locking hole to be fastened to the locking hole in a press-fit method.

According to another aspect of the invention, the locking pin may include a head and a shank. A diameter of the shank may be larger than a diameter of the locking hole by about 0.02 mm to 0.06 mm.

In another aspect of this embodiment, the locking hole may include a threaded part provided on an inside portion of the locking hole, and a non-threaded part provided on an outside portion of the locking hole. The shank of the locking pin may include a threaded part to correspond to the threaded part of the locking hole, and a non-threaded part to correspond to the non-threaded part of the locking hole. In this case, the threaded part of the locking pin may be fastened to the inside portion of the locking hole in a screw fastening method, and the non-threaded part of the locking pin may be fastened to the outside portion of the locking hole in a non-screw fastening method.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
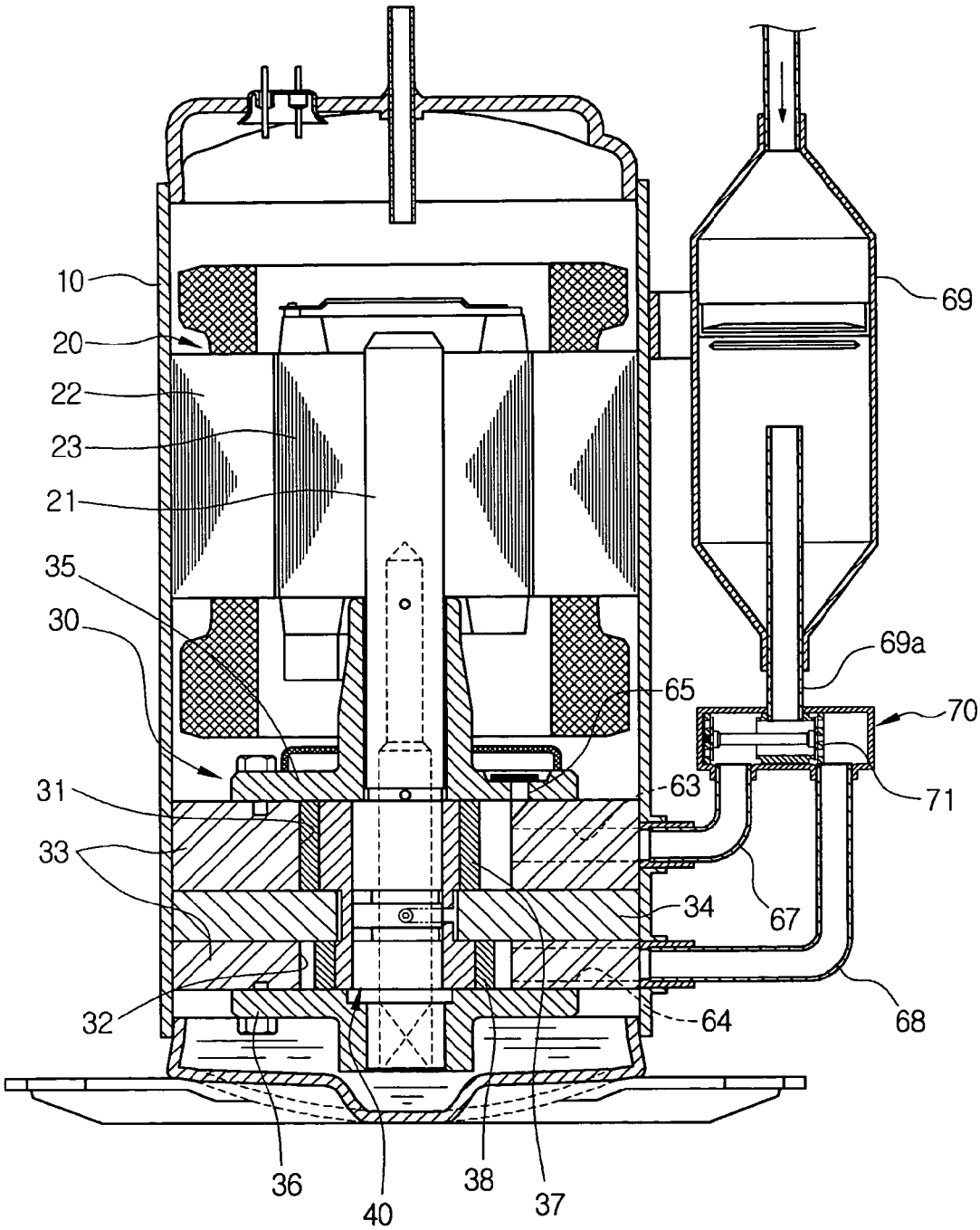
FIG. 1 is a sectional view to show an interior construction of a variable capacity rotary compressor, according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

FIG. 1 is a sectional view to show a variable capacity rotary compressor, according to an embodiment of the present invention. As shown in FIG. 1, the variable capacity rotary compressor includes a hermetic casing 10, with a drive unit 20 and a compressing unit 30 being installed in the hermetic casing 10. The drive unit 20 generates a rotating force, and the compressing unit 30 compresses gas using the rotating force of the drive unit 20. The drive unit 20 includes a cylindrical stator 22, a rotor 23, and a rotating shaft 21. The stator 22 is fixedly mounted to an inner surface of the hermetic casing 10. The rotor 23 is rotatably installed in the stator 22. The rotating shaft 21 is installed to pass through a center of the rotor 23, and rotates along with the rotor 23 in a first direction which is counterclockwise in the drawings or in a second direction which is clockwise in the drawings.

The compressing unit 30 includes a housing 33, upper and lower flanges 35 and 36, and a partition 34. The housing 33 defines upper and lower compression chambers 31 and 32, which are both cylindrical but have different capacities, therein. The upper and lower flanges 35 and 36 are mounted to upper and lower ends of the housing 33, respectively, to rotatably support the rotating shaft 21. The partition 34 is interposed between the upper and lower compression chambers 31 and 32 to partition the upper and lower compression chambers 31 and 32 from each other.

The upper compression chamber 31 is taller than the lower compression chamber 32, thus the upper compression chamber 31 has a larger capacity than the lower compression chamber 32. Therefore, a larger amount of gas is compressed in the upper compression chamber 31 in comparison with the lower compression chamber 32, to allow the rotary compressor to have a variable capacity.

Of course, when the lower compression chamber 32 is taller than the upper compression chamber 31, the lower compression chamber 32 has a larger capacity than the upper compression chamber 31 to allow a larger amount of gas to be compressed in the lower compression chamber 32.

Further, an eccentric unit 40 is placed in the upper and lower compression chambers 31 and 32 to execute a compressing operation in either the upper or lower compression chamber 31 and 32, according to a rotating direction of the rotating shaft 21. The construction and operation of the eccentric unit 40 will be described later herein, with reference to FIGS. 2 through 7.

Upper and lower rollers 37 and 38 are placed in the upper and lower compression chambers 31 and 32, respectively, to be rotatably fitted over the eccentric unit 40. Upper inlet and outlet ports 63 and 65 (see, FIG. 4) are formed at predetermined positions of the housing 33 to communicate with the upper compression chamber 31. Lower inlet and outlet ports 64 and 66 (see, FIG. 6) are formed at predetermined positions of the housing 33 to communicate with the lower compression chamber 32.

Figure 4:
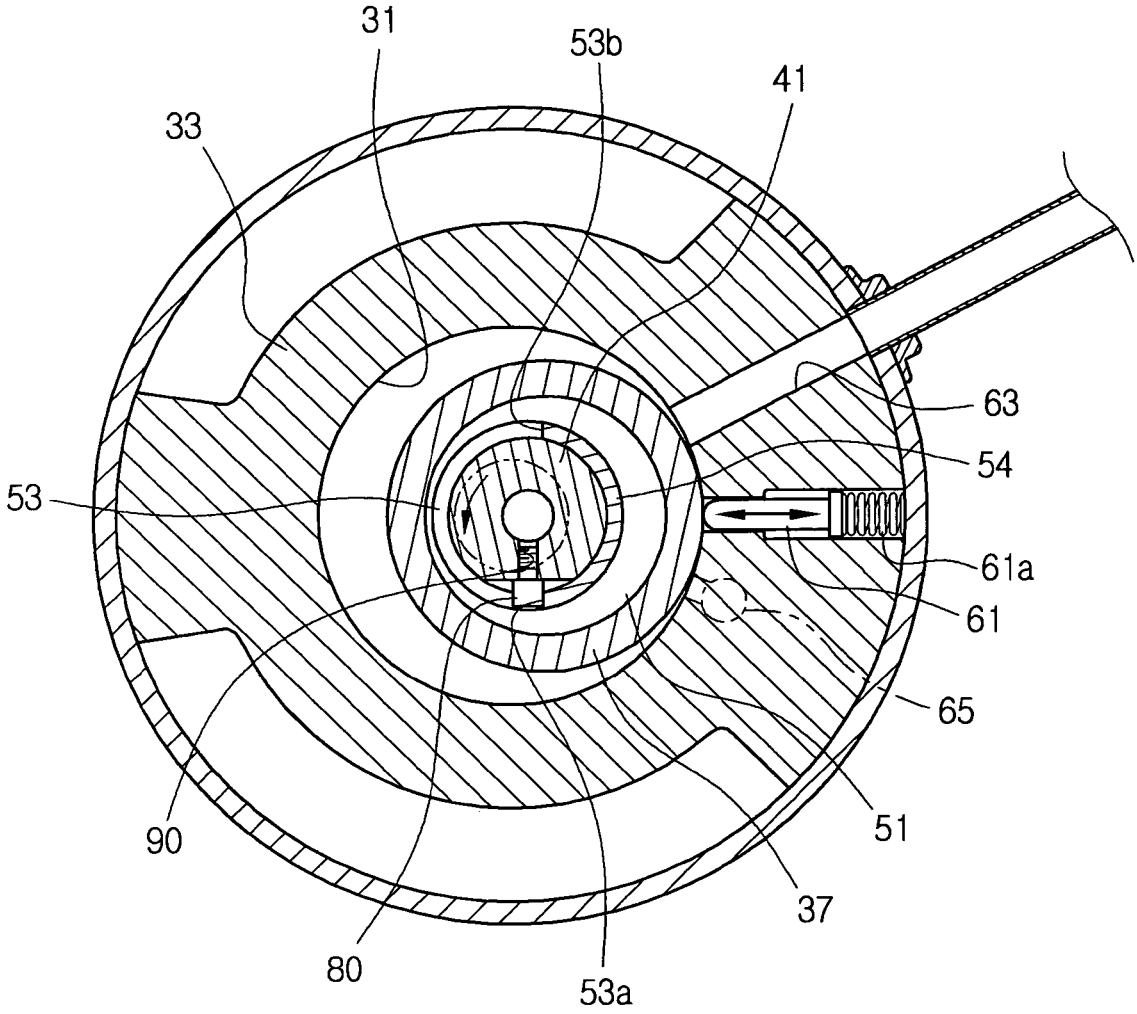
FIG. 4 is a sectional view to show an upper compression chamber where a compression operation is executed by the eccentric unit of FIG. 2, when the rotating shaft rotates in a first direction.

An upper vane 61 is positioned between the upper inlet and outlet ports 63 and 65, and is biased in a radial direction by an upper support spring 61*a* to be in close contact with the upper roller 37 (see, FIG. 4). Further, a lower vane 62 is positioned between the lower inlet and outlet ports 64 and 66, and is biased in a radial direction by a lower support spring 62*a* to be in close contact with the lower roller 38 (see, FIG. 6).

Further, a refrigerant outlet pipe 69*a* extends from an accumulator 69 containing a refrigerant therein. Of the refrigerant contained in the accumulator 69, only a gas refrigerant flows into the compressor through the refrigerant outlet pipe 69*a*. At a predetermined position of the refrigerant outlet pipe 69*a* is installed a path control unit 70. The path control unit 70 opens an intake path 67 or 68, to supply the gas refrigerant to the upper or lower inlet port 63 or 64 of the upper or lower compression chamber 31 or 32 in which a compression operation is executed. A valve 71 is installed in the path control unit 70 to be movable in a horizontal direction. The valve 71 opens either the intake paths 67 or 68 by a pressure difference between the intake path 67 connected to the upper inlet port 63 and the intake path 68 connected to the lower inlet port 64, thus supplying the gas refrigerant to the upper inlet port 63 or lower inlet port 64.

The construction of the rotating shaft and the eccentric unit according to the present invention will be described in the following with reference to FIGS. 2 and 3.

Figure 2:
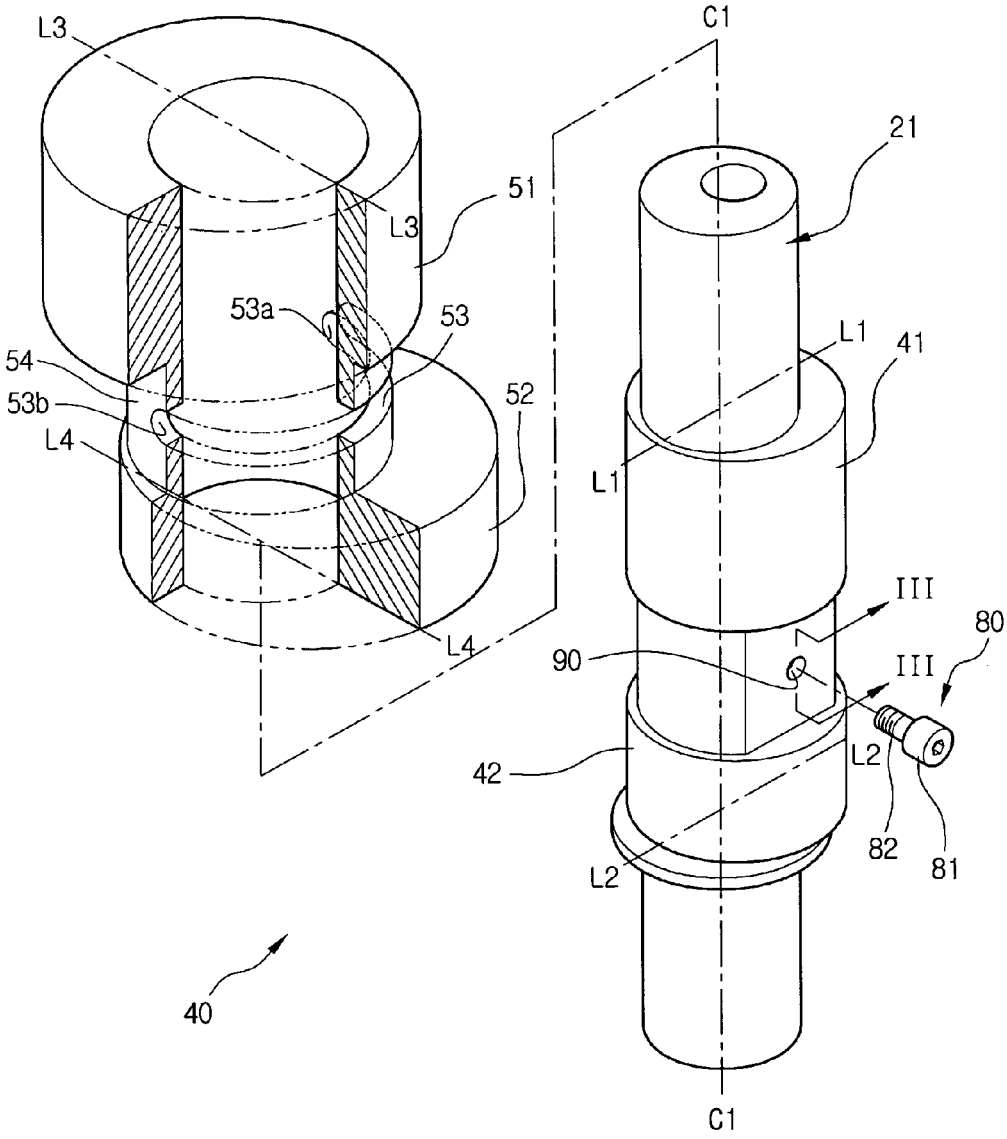
FIG. 2 is an exploded perspective view of an eccentric unit of the compressor of FIG. 1, in which upper and lower eccentric bushes of the eccentric unit are separated from a rotating shaft.

FIG. 2 is an exploded perspective view of the eccentric unit of the compressor of FIG. 1, in which upper and lower eccentric bushes of the eccentric unit are separated from the rotating shaft. FIG. 3 shows a locking pin and a locking hole into which the locking pin is fitted.

As shown in FIG. 2, the eccentric unit 40 includes upper and lower eccentric cams 41 and 42. The upper and lower eccentric cams 41 and 42 are provided on the rotating shaft 21 to be placed in the upper and lower compression chambers 31 and 32, respectively. Upper and lower eccentric bushes 51 and 52 are fitted over the upper and lower eccentric cams 41 and 42, respectively. A locking pin 80 is provided at a predetermined position between the upper and lower eccentric cams 41 and 42. A slot 53 of a predetermined length is provided at a predetermined position between the upper and lower eccentric bushes 51 and 52 to engage with the locking pin 80, when the rotating shaft 21 rotates in the first or second direction.

The upper and lower eccentric cams 41 and 42 are integrally provided on the rotating shaft 21 to be eccentric from a central axis C1—C1 of the rotating shaft 21. The upper and lower eccentric cams 41 and 42 are positioned so that an upper eccentric line L1—L1 of the upper eccentric cam 41 corresponds to a lower eccentric line L2—L2 of the lower eccentric cam 42. In this case, the upper eccentric line L1—L1 is defined as a line to connect a maximum eccentric part of the upper eccentric cam 41, which is maximally projected from the rotating shaft 21, to a minimum eccentric part of the upper eccentric cam 41, which is minimally projected from the rotating shaft 21. Meanwhile, the lower eccentric line L2—L2 is defined as a line to connect a maximum eccentric part of the lower eccentric cam 42, which is maximally projected from the rotating shaft 21, to a minimum eccentric part of the lower eccentric cam 42, which is minimally projected from the rotating shaft 21.

In this case, a vertical length of the upper eccentric cam 41 is equal to a height of the upper compression chamber 31, and a vertical length of the lower eccentric cam 42 is equal to a height of the lower compression chamber 32.

The locking pin 80 includes a head 81 and a shank 82. A fastening slot is formed on a predetermined portion of the head 81. The shank 82 extends from the head 81 to a predetermined length, and has a slightly smaller diameter than the head 81. The locking hole 90 is formed on a predetermined portion of the rotating shaft 21 between the upper and lower eccentric cams 41 and 42 to be at an angle of about 90° with the upper and lower eccentric lines L1—L1 and L2—L2. By fitting the shank 82 of the locking pin 80 into the locking hole 90, the locking pin 80 is fastened to the rotating shaft 21. A detailed construction of the locking pin 80 fitted into the locking hole 90 of the rotating shaft 21 will be described later with reference to FIG. 3.

The upper and lower eccentric bushes 51 and 52 are integrated with each other by a connecting part 54 which connects the upper and lower eccentric bushes 51 and 52 to each other. In this case, the upper eccentric bush 51 has a vertical length that is slightly shorter than the upper eccentric cam 41. Further, the lower eccentric bush 52 has a vertical length that is slightly shorter than the lower eccentric cam 42. A width of the slot 53 is slightly greater than a diameter of the head 81 of the locking pin 80, and is formed around a part of the connecting part 54.

Therefore, the upper and lower eccentric bushes 51 and 52, integrally connected to each other by the connecting part 54, are fitted over the rotating shaft 21. Next, the locking pin 80 is fastened to the locking hole 90 of the rotating shaft 21 through the slot 53. Thereby, the locking pin 80 is fastened to the rotating shaft 21 while being fitted into the slot 53.

In such a state, when the rotating shaft 21 rotates in the first or second direction, the locking pin 80 is stopped by one of first and second ends 53*a* and 53*b* of the slot 53. However, until the locking pin 80 is stopped by one of the first and second ends 53*a* and 53*b* of the slot 53, neither the upper nor lower eccentric bush 51 or 52 rotates. When the locking pin 80 is stopped by one of the first and second ends 53*a* and 53*b* of the slot 53, the upper or lower eccentric bush 51 or 52 rotates in the first or second direction along with the rotating shaft 21.

An eccentric line L3—L3, which connects a maximum eccentric part of the upper eccentric bush 51 to a minimum eccentric part thereof, is placed approximately 90° from a line which connects the first end 53*a* of the slot 53 to a center of the connecting part 54. Meanwhile, an eccentric line L4—L4, which connects a maximum eccentric part of the lower eccentric bush 52 to a minimum eccentric part thereof, is placed approximately 90° from a line which connects the second end 53*b* of the slot 53 to the center of the connecting part 54.

Further, the eccentric line L3—L3 of the upper eccentric bush 51 and the eccentric line L4—L4 of the lower eccentric bush 52 are positioned on a same plane, but the maximum eccentric part of the upper eccentric bush 51 is opposite to the maximum eccentric part of the lower eccentric bush 52. In this case, the slot 53 is formed around a part of the connecting part 54 so that an angle between a first line extending from the first end 53*a* of the slot 53 to a center of the rotating shaft 21 and a second line extending from the second end 53*b* of the slot 53 to the center of the rotating shaft 21 is approximately 180°.

When the first end 53*a* of the slot 53 stops the locking pin 80 and the upper eccentric bush 51 rotates along with the rotating shaft 21 in the first direction (of course, the lower eccentric bush 52 also rotates), the maximum eccentric part of the upper eccentric cam 41 contacts the maximum eccentric part of the upper eccentric bush 51. Thus, the upper eccentric bush 51 rotates along with the rotating shaft 21 in the first direction while being maximally eccentric from the rotating shaft 21 (see, FIG. 4). Meanwhile, in the case of the lower eccentric bush 52, the maximum eccentric part of the lower eccentric cam 42 contacts the minimum eccentric part of the lower eccentric bush 52. Thus, the lower eccentric bush 52 rotates along with the rotating shaft 21 in the first direction while being concentric with the rotating shaft 21 (see, FIG. 5).

Conversely, when the locking pin 80 is stopped by the second end 53*b* of the slot 53 and the lower eccentric bush 52 rotates along with the rotating shaft 21 in the second direction, the maximum eccentric part of the lower eccentric cam 42 contacts the maximum eccentric part of the lower eccentric bush 52. Thus, the lower eccentric bush 51 rotates along with the rotating shaft 21 in the second direction while being maximally eccentric from the rotating shaft 21 (see, FIG. 6). Meanwhile, in the case of the upper eccentric bush 51, the maximum eccentric part of the upper eccentric cam 41 contacts the minimum eccentric part of the upper eccentric bush 51. Thus, the upper eccentric bush 51 rotates along with the rotating shaft 21 in the second direction while being concentric with the rotating shaft 21 (see, FIG. 7).

The locking pin 80 is firmly fastened to the locking hole 90 of the rotating shaft 21. The structure for fastening the locking pin 80 to the locking hole 90 will be described in the following with reference to FIG. 3.

Figure 3:
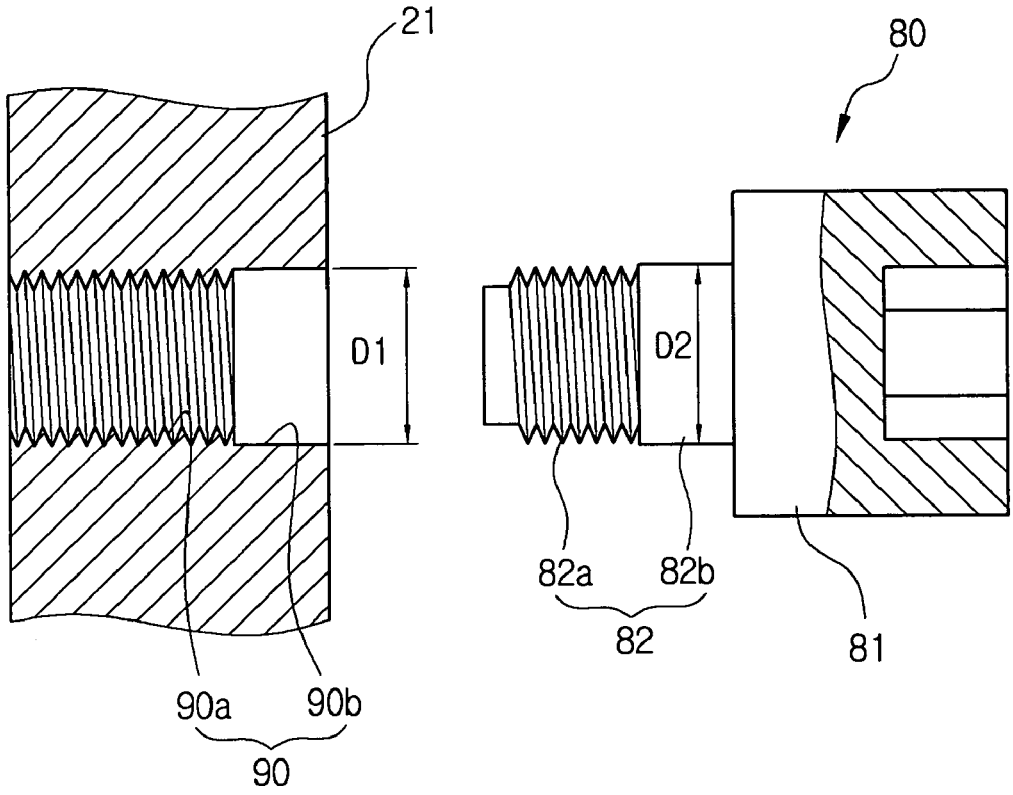
FIG. 3 is a sectional view taken along a line III—III of FIG. 2, to show a locking pin and a locking hole into which the locking pin is fitted.

As shown in FIG. 3, the locking hole 90 has a predetermined diameter D1. A threaded part 90*a* having a predetermined pitch is provided on an inside portion of the locking hole 90, and a non-threaded part 90*b* is provided on an outside portion of the locking hole 90. The non-threaded part 90*b* inwardly extends from an outer surface to a predetermined portion of the rotating shaft 21. The threaded part 90*a* inwardly extends from the non-threaded part 90*b* to a predetermined portion of the rotating shaft 21 so that the locking pin 90 is fastened to the threaded part 90*a* of the locking hole 90 in a screw fastening method.

Further, the locking pin 80 having the head 81 and the shank 82 is provided so that a diameter D2 of the shank 82 is slightly larger than the diameter D1 of the locking hole 90. The shank 82 of the locking pin 80 includes a threaded part 82*a* to correspond to the threaded part 90*a* of the locking hole 90, and a non-threaded part 82*b* to correspond to the non-threaded part 90*b* of the locking hole 90.

A difference between the diameter D2 of the shank 82 and the diameter D1 of the locking hole 90 is about 0.02 mm to 0.06 mm so that the shank 82 of the locking pin 80 is fastened to the locking hole 90 of the rotating shaft 21 in a press-fit method.

When the locking pin 80 is inserted into the locking hole 90 and the head 81 of the locking pin 80 is rotated, the threaded part 82*a* of the shank 82 is fastened to the threaded part 90*a* provided on the inside portion of the locking hole 90 in the screw fastening method. Simultaneously, the non-threaded part 82*b* of the shank 82 is fitted into the non-threaded part 90*b* provided on the outside portion of the locking hole 90 in the press-fit method.

Therefore, although a vibration or any impact resulting from an operation of the eccentric unit 40 acts on the locking pin 80, the locking pin 80 remains firmly fastened to the locking hole 90 without being loosened from the locking hole 90.

The operation of compressing the gas refrigerant in the upper or lower compression chamber 31 or 32 by the eccentric unit 40 according to an embodiment of the present invention will be described in the following with reference to FIGS. 4 through 7.

Figure 5:
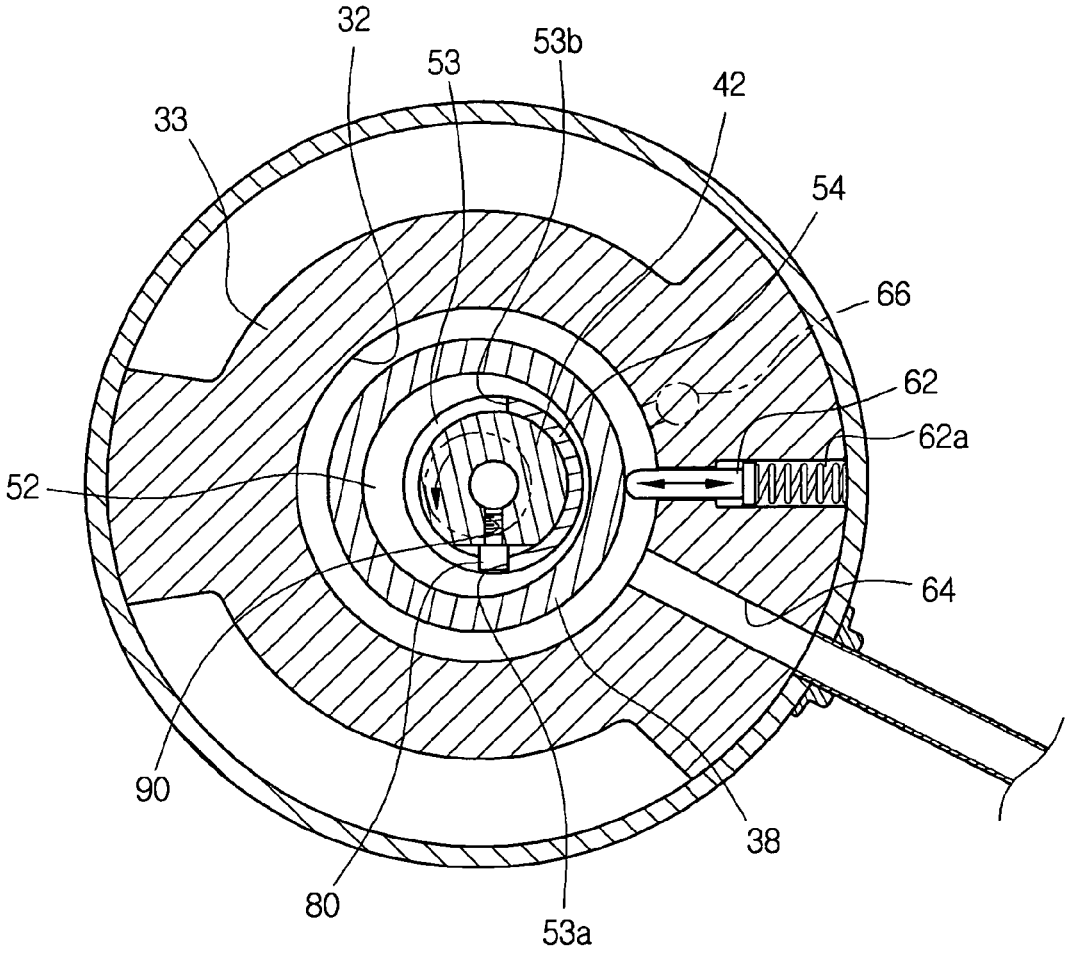
FIG. 5 is a sectional view, corresponding to FIG. 4, to show a lower compression chamber where an idle operation is executed by the eccentric unit of FIG. 2, when the rotating shaft rotates in the first direction.

FIG. 4 is a sectional view to show the upper compression chamber where the compression operation is executed by the eccentric unit of FIG. 2, when the rotating shaft rotates in the first direction. FIG. 5 is a sectional view, corresponding to FIG. 4, to show the lower compression chamber where an idle operation is executed by the eccentric unit of FIG. 2, when the rotating shaft rotates in the first direction.

As shown in FIG. 4, when the rotating shaft 21 rotates in the first direction (which is counterclockwise in FIG. 4), the locking pin 80 projected from the rotating shaft 21 rotates at a predetermined angle while engaging with the slot 53 which is provided at a predetermined position between the upper and lower eccentric bushes 51 and 52. At this time, the head 81 of the locking pin 80 is stopped by the first end 53*a* of the slot 53, so that the upper eccentric bush 51 rotates along with the rotating shaft 21.

When the locking pin 80 is stopped by the first end 53*a* of the slot 53, the maximum eccentric part of the upper eccentric cam 41 contacts the maximum eccentric part of the upper eccentric bush 51. In this case, the upper eccentric bush 51 rotates while being maximally eccentric from the central axis C1—C1 of the rotating shaft 21. Thus, the upper roller 37 rotates while being in contact with an inner surface of the housing 33 to define the upper compression chamber 31, thus executing the compression operation.

Simultaneously, as shown in FIG. 5, the maximum eccentric part of the lower eccentric cam 42 contacts the minimum eccentric part of the lower eccentric bush 52. In this case, the lower eccentric bush 52 rotates while being concentric with the central axis C1—C1 of the rotating shaft 21. Thus, the lower roller 38 rotates while being spaced apart from the inner surface of the housing 33, which defines the lower compression chamber 32, by a predetermined interval, thus the compression operation is not executed.

Therefore, when the rotating shaft 21 rotates in the first direction, the gas refrigerant flowing to the upper compression chamber 31 through the upper inlet port 63 is compressed by the upper roller 37 in the upper compression chamber 31 having a larger capacity, and subsequently is discharged from the upper compression chamber 31 through the upper outlet port 65. On the other hand, the compression operation is not executed in the lower compression chamber 32 having a smaller capacity. Therefore, the rotary compressor is operated in a larger capacity compression mode.

Figure 6:
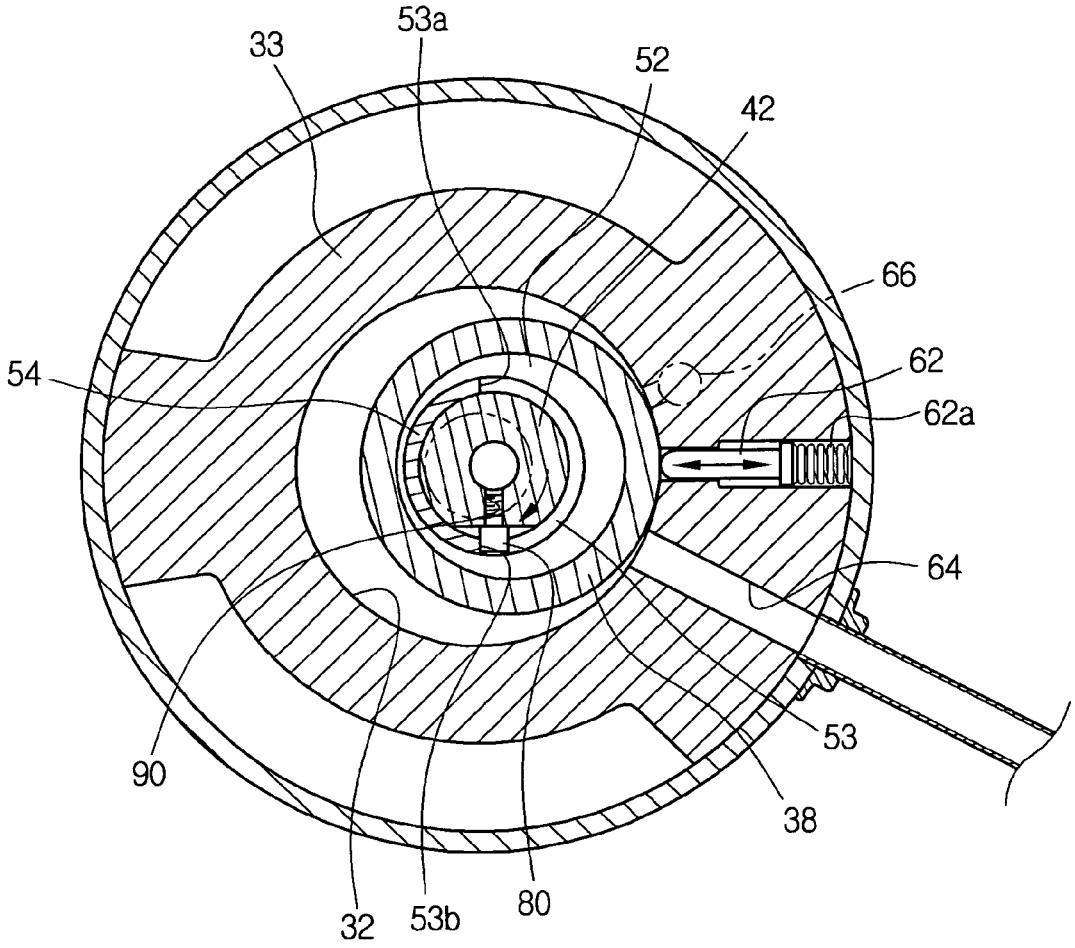
FIG. 6 is a sectional view to show the lower compression chamber where the compression operation is executed by the eccentric unit of FIG. 2, when the rotating shaft rotates in a second direction.
Figure 7:
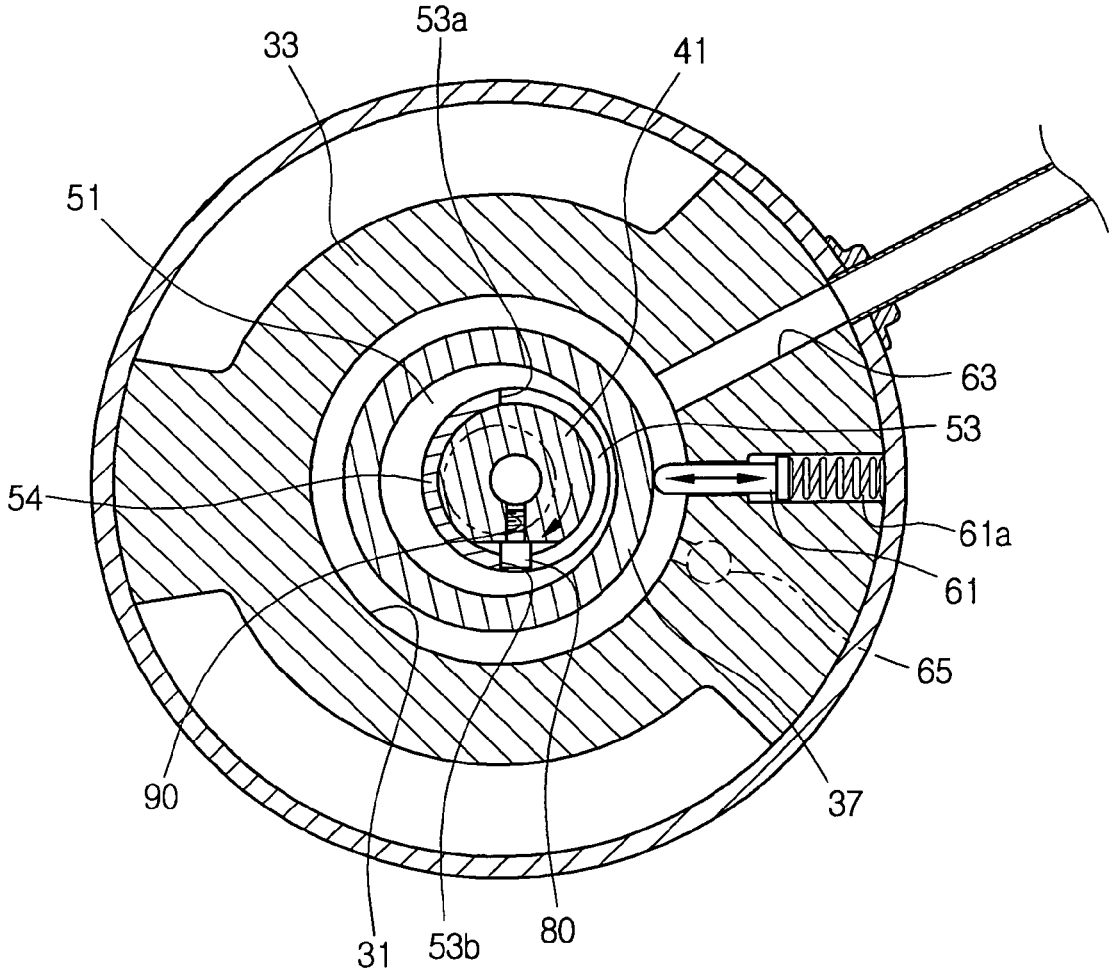
FIG. 7 is a sectional view, corresponding to FIG. 6, to show the upper compression chamber where the idle operation is executed by the eccentric unit of FIG. 2, when the rotating shaft rotates in the second direction.

FIG. 6 is a sectional view to show the lower compression chamber where the compression operation is executed by the eccentric unit of FIG. 2, when the rotating shaft rotates in the second direction. FIG. 7 is a sectional view, corresponding to FIG. 6, to show the upper compression chamber where the idle operation is executed by the eccentric unit of FIG. 2, when the rotating shaft rotates in the second direction.

As shown in FIG. 6, when the rotating shaft 21 rotates in the second direction (which is clockwise in FIG. 6), the compression operation is executed in only the lower compression chamber 32, oppositely to the operation of FIGS. 4 and 5 to show the case where the compression operation is executed in only the upper compression chamber 31.

In a detailed description, when the rotating shaft 21 rotates in the second direction, the locking pin 80 projected from the rotating shaft 21 is stopped by the second end 53*b* of the slot 53. Thus, the lower and upper eccentric bushes 52 and 51 rotate by the rotating shaft 21 in the second direction.

In this case, the maximum eccentric part of the lower eccentric cam 42 contacts the maximum eccentric part of the lower eccentric bush 52, thus the lower eccentric bush 52 rotates while being maximally eccentric from the central axis C1—C1 of the rotating shaft 21. Therefore, the lower roller 38 rotates while being in contact with the inner surface of the housing 33 which defines the lower compression chamber 32, to execute the compression operation.

Simultaneously, as shown in FIG. 7, the maximum eccentric part of the upper eccentric cam 41 contacts the minimum eccentric part of the upper eccentric bush 51. In this case, the upper eccentric bush 51 rotates while being concentric with the central axis C1—C1 of the rotating shaft 21. Thus, the upper roller 37 rotates while being spaced apart from the inner surface of the housing 33, which defines the upper compression chamber 31, by a predetermined interval, thus the compression operation is not executed.

Therefore, the gas refrigerant flowing to the lower compression chamber 32 through the lower inlet port 64 is compressed by the lower roller 38 in the lower compression chamber 32 having the smaller capacity, and subsequently is discharged from the lower compression chamber 32 through the lower outlet port 66. On the other hand, the compression operation is not executed in the upper compression chamber 31 having the larger capacity. Therefore, the rotary compressor is operated in a smaller capacity compression mode.

As described above, in the case where the vibration resulting from a rotation of the rotating shaft 21, the upper and lower eccentric bushes 51 and 52, and the upper and lower rollers 37 and 38, is continuously transmitted to the locking pin 80 fastened to the locking hole 90, the locking pin 80 may be loosened from the locking hole 90. However, the shank 82 of the locking pin 80 has a slightly larger diameter than the locking hole 90 to be fitted into the locking hole 90 in the press-fit fastening method, and the shank 82 of the locking pin 80 has the threaded part 82*a* and the locking hole 90 has the threaded part 90*a* to correspond to the threaded part 82*a* of the shank 82, thus preventing the locking pin 80 from being loosened from the locking hole 90.

As is apparent from the above description, the present invention provides a variable capacity rotary compressor, which is designed to execute a compression operation in either of upper and lower compression chambers having different capacities by an eccentric unit which rotates in the first or second direction, thus varying a compression capacity of the compressor as desired.

In the variable capacity rotary compressor of the present invention, a locking pin serving as a clutch is firmly fastened to a locking hole provided on a predetermined portion of the rotating shaft, thus preventing the locking pin from being loosened from the locking hole although a vibration is transmitted to the locking pin, and thereby allowing the eccentric unit to smoothly rotate.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A variable capacity rotary compressor, comprising:

upper and lower compression chambers having different capacities;

a rotating shaft passing through the upper and lower compression chambers, with a locking hole provided on a predetermined portion of the rotating shaft;

upper and lower eccentric cams on the rotating shaft in the upper and lower compression chambers, respectively to be eccentric from the rotating shaft;

upper and lower eccentric bushes fitted over the upper and lower eccentric cams, respectively;

a slot at a position between the upper and lower eccentric bushes; and a locking pin, fitted into the locking hole of the rotating shaft to be stopped by an of opposite ends of the slot according to a rotating direction of the rotating shaft, having a larger diameter than the locking hole such that the locking pin is required to be press-fit in place.

2. The variable capacity rotary compressor according to claim 1, wherein the locking pin comprises:

a head; and a shank, with a diameter of the shank being larger than a diameter of the locking hole by about 0.02mm to 0.06mm.

3. The variable capacity rotary compressor according to claim 2, wherein the locking hole comprises:

a threaded part provided on an inside portion of the locking hole; and a non-threaded part provided on an outside portion of the locking hole, and the shank of the locking pin comprises:

a threaded part to correspond to the threaded part of the locking hole, the threaded part of the locking pin being fastened to the inside portion of the locking hole in a screw fastening method; and a non-threaded part to correspond to the non-threaded part of the locking hole, the non-threaded part of the locking pin being fastened to the outside portion of the locking hole in a non- screw fastening method.

4. A variable capacity rotary compressor, comprising:

upper and lower compression chambers having different capacities;

a rotating shaft passing through the upper and lower compression chambers, with a locking hole provided on a predetermined portion of the rotating shaft;

upper and lower eccentric cams on the rotating shaft in the upper and lower compression chambers, respectively to be eccentric from the rotating shaft;

upper and lower eccentric bushes fitted over the upper and lower eccentric cams, respectively;

a slot at a position between the upper and lower eccentric bushes; and a locking pin, fitted into the locking hole of the rotating shaft to be stopped by either of opposite ends of the slot according to a rotating direction of the rotating shaft, fastened at a first part thereof to an inside portion of the locking hole in a screw fastening method, and at a second part thereof to an outside portion of the locking hole in a non- screw fastening method.

5. The variable capacity rotary compressor according to claim 4, wherein the locking hole comprises:

a threaded part provided on the inside portion of the locking hole; and a non-threaded part provided on the outside portion of the locking hole, and the locking pin comprises:

a threaded part to correspond to the threaded part of the locking hole, the threaded part of the locking pin being fastened to the inside portion of the locking hole in the screw fastening method; and a non-threaded part to correspond to the non-threaded part of the locking hole, the non-threaded part of the locking pin being fastened to the outside portion of the locking hole in the non- screw fastening method.

6. The variable capacity rotary compressor according to claim 5, wherein the locking pin comprises:

a head; and a shank, with the threaded part and the non-threaded part of the locking pin being provided on the shank, the shank having a larger diameter than the locking hole to be fastened to the locking hole in a press-fit method.

7. The variable capacity rotary compressor according to claim 6, wherein the shank and the locking hole have diameters which are different from each other within a range of about 0.02mm to 0.06mm.

8. A rotary compressor, including compression chambers in which various compression operations are carried out, a rotating shaft having a locking hole passing through the compression chambers, eccentric cams in the compression chambers and on the rotating shaft to be eccentric from the rotating shaft, and eccentric bushes fitted over the eccentric cams, the rotary compressor comprising:

a slot, having opposite ends, between the upper and lower eccentric bushes; and a locking pin fitted into the locking hole to be stopped by one of the opposite ends of the slot according to a rotating direction of the rotating shaft, and having a larger diameter than the locking hole such that the locking pin is required to be press-fit to the locking hole.

9. The rotary compressor according to claim 8, wherein the locking pin comprises:

a head; and a shank extending from the head to a predetermined length.

10. The rotary compressor according to claim 9, wherein a diameter of the shank is larger than a diameter of the locking hole by substantially 0.02mm to 0.06mm.

11. The rotary compressor according to claim 10, further comprising:

a threaded part provided on an inside portion of the locking hole; and a non-threaded part provided on an outside portion of the locking hole.

12. The rotary compressor according to claim 11, wherein the shank comprises:

a threaded part to correspond to the threaded part of the locking hole, and to be fastened to the inside portion of the locking hole in a screw fastening method; and a non-threaded part to correspond to the non-threaded part of the locking hole, and to be fastened to the outside portion of the locking hole in a non- screw fastening method.

* * * * *

UNITED STATES PATENT AND TRADEMARK OFFICE

CERTIFICATE OF CORRECTION

PATENT NO. : 7,150,608 B2
APPLICATION NO. : 10/923736
DATED : December 19, 2006
INVENTOR(S) : Sung Hea Cho et al.

It is certified that error appears in the above-identified patent and that said Letters Patent is hereby corrected as shown below:

On Title Page, Item (56) (U.S. Patent Documents), Line 1, change "Reudi et al." to --Ruedi et al.--.

Signed and Sealed this

Twenty-seventh Day of March, 2007

JON W. DUDAS
*Director of the United States Patent and Trademark Office*